US006646538B2

(12) United States Patent
Morbitzer

(10) Patent No.: US 6,646,538 B2
(45) Date of Patent: Nov. 11, 2003

(54) TEMPERATURE LIMITER, AND CALIBRATION METHOD FOR OPERATING A SWITCHING CONTACT OF A TEMPERATURE LIMITER

(75) Inventor: Hans-Peter Morbitzer, Atzenbrugg (AT)

(73) Assignee: Electrovac, Fabrikation elektrotechnischer Spezialartikel Gesellschft m.b.H., Klosterneuburg (AT)

( * ) Notice: Subject to any disclaimer, the term of this patent is extended or adjusted under 35 U.S.C. 154(b) by 0 days.

(21) Appl. No.: 10/122,803

(22) Filed: Apr. 15, 2002

(65) Prior Publication Data

US 2002/0149465 A1 Oct. 17, 2002

(51) Int. Cl.[7] ..... H01H 37/48
(52) U.S. Cl. ..... 337/394
(58) Field of Search ..... 337/394, 392, 337/393, 398, 400, 303, 347, 360, 368, 382, 383, 417

(56) References Cited

U.S. PATENT DOCUMENTS

| | | | | | |
|---|---|---|---|---|---|
| 2,418,647 | A | * | 4/1947 | Jordan | 337/400 |
| 2,703,832 | A | * | 3/1955 | Reingruber et al. | 337/400 |
| 2,705,747 | A | * | 4/1955 | Strange | 337/394 |
| 3,004,123 | A | * | 10/1961 | Cannon | 337/393 |
| 3,029,329 | A | * | 4/1962 | Bolesky | 337/386 |
| 3,194,927 | A | * | 7/1965 | Place | 337/387 |
| 3,243,557 | A | * | 3/1966 | Fairbanks | 337/394 |
| 3,327,946 | A | * | 6/1967 | Benson | 236/48 R |
| 3,899,765 | A | * | 8/1975 | Daigneault, Jr. | 337/386 |
| 4,901,049 | A | * | 2/1990 | Kicherer et al. | 337/394 |
| 5,055,819 | A | * | 10/1991 | Goessler et al. | 337/394 |
| 5,138,297 | A | * | 8/1992 | Hollweck | 337/354 |
| 5,310,993 | A | * | 5/1994 | McWilliams et al. | 219/448.19 |
| 5,420,398 | A | * | 5/1995 | Petri et al. | 219/505 |
| 5,627,507 | A | * | 5/1997 | Morbitzer et al. | 337/394 |
| 6,007,327 | A | * | 12/1999 | Morbitzer | 431/75 |
| 6,304,165 | B1 | * | 10/2001 | Petri et al. | 337/394 |

FOREIGN PATENT DOCUMENTS

| | | | | |
|---|---|---|---|---|
| AT | 387 664 B | | 2/1989 | |
| DE | 35 40 414 A1 | | 5/1987 | |
| DE | 40 01 790 C1 | | 5/1991 | |
| EP | 901310 A2 | * | 3/1999 | H05B/01/02 |
| GB | 2315848 A | * | 2/1998 | F24C/03/10 |

* cited by examiner

*Primary Examiner*—Anatoly Vortman
(74) *Attorney, Agent, or Firm*—Henry M. Feiereisen

(57) ABSTRACT

A temperature limiter includes a switch head with a switching contact and a temperature sensor having elongate expansion elements of different thermal expansion coefficients. The expansion elements are fixed relative to one another in one end zone and movable relative to one another in the other end zone. Slidably supported in the switch head is a ram which abuts against the movable expansion element and has an end portion constructed to allow application of welding or soldering. A switch sleeve is placed over the ram end portion and adapted to actuate the contact. The switch sleeve is movable relative to the ram during a calibration phase, until reaching a position which is determinative for calibrating a desired response temperature of the switching contact. In this position, the switch sleeve is then securely fixed to the end portion by fusion welding or soldering.

16 Claims, 6 Drawing Sheets

TEMPERATURE LIMITER, AND CALIBRATION METHOD FOR OPERATING A SWITCHING CONTACT OF A TEMPERATURE LIMITER

CROSS-REFERENCES TO RELATED APPLICATIONS

This application claims the priority of Austrian Patent Application, Serial No. A 621/2001, filed Apr. 17, 2001, pursuant to 35 U.S.C. 119(*a*)–(*d*), the subject matter of which is incorporated herein by reference.

BACKGROUND OF THE INVENTION

The present invention relates, in general, to a temperature limiter.

Typically, temperature limiters, involved here, include a switch head with a switching contact, and a temperature sensor in the form of elongate expansion elements which have different thermal expansion coefficients and are defined by a switch head distal end zone in which the expansion elements are fixed immobile relative to one another, and a switch head proximal end zone in which one of the expansion elements is movable relative to the other expansion element. A ram is slidably supported in the switch head and abuts against the movable expansion element, whereby the ram has an end portion which is operatively connected to the switching contact.

The response temperature at which the switching contact is actuated by the ram is dependent on the distance between the switching contact and the ram part that actually acts on the switching contact. Therefore, this distance must be adjusted to set the response temperature. The adjustment can be implemented by manufacturing the ram with precise dimensions or by mechanical finishing the ram, e.g., precision cutting, grinding or the like. This approach is disadvantageous because the finishing process can be carried out only when the temperature limiter is disassembled. As a result, the ram has to be removed from the switch head in order to carry out finishing works. Needless to say that the calibration of the response temperature is complicated and inefficient.

Conventional calibration devices are known which include a switch sleeve placed over the end portion of the ram for actuation of the switching contact. The switch sleeve has an internal thread for threaded engagement of a stud bolt which rests with one end face against the ram. Thus, turning the stud bolt results in a displacement of the switch sleeve relative to the ram to thereby allow adjustment of the response temperature of the switching contact. This approach is also disadvantageous because the use of the stud bolt is inaccurate as even slight turns of the stud bolt are accompanied by a relatively substantial displacement of the switch sleeve. A fine-tuned calibration becomes thus impossible. Further, the stud bolt is prone to self-turning during the course of time, especially because of the exposure to frequent temperature changes and to frequent displacement forces. These turns of the stud bolt lead necessarily to an alteration of the set response temperature.

It would therefore be desirable and advantageous to provide an improved temperature limiter which obviates prior art shortcomings and which is configured to enable simple calibration of the response temperature of the switch contact in a very accurate manner.

SUMMARY OF THE INVENTION

According to one aspect of the present invention, a temperature limiter, includes a switch head including at least one switching contact; a temperature sensor including elongate expansion elements which have different thermal expansion coefficients and are defined by a switch head distal first end zone at which the expansion elements are fixed immobile relative to one another, and a switch head proximal second end zone at which one of the expansion elements is movable relative to the other expansion element; a ram slidably supported in the switch head and abutting against the movable expansion element, with the ram having an end portion which is situated in an area of the switching contact and constructed to allow application of a welding or soldering process; and a switch sleeve placed over the end portion of the ram and adapted for actuation of the switching contact, wherein the switch sleeve is movable relative to the ram during a calibration phase, until reaching a position which is determinative for calibrating a desired response temperature of the switching contact and in which position the switch sleeve is securely fixed to the end portion of the ram through a process selected from the group consisting of fusion welding and soldering.

In a temperature limiter according to the present invention, the switch sleeve can be shifted very precisely even over small distances into the desired position where the switch sleeve is then permanently secured to the ram through welding or soldering. Inadvertent shifts of the switch sleeve and resulting alterations of the set response temperature are effectively eliminated, once the calibration has been implemented.

According to another feature of the present invention, the switch sleeve may be connected to the end portion by laser welding or laser soldering. Such a connection can be established easily, when the temperature limiter is fully assembled because the laser beam utilized for heating the parts being welded or soldered together requires only little space.

According to another feature of the present invention, the switch sleeve may be provided with a gripping aid, e.g., in the form of a pin or in the form of indentations in or roughening of an outer surface area of the switch sleeve. In this way, application of forces required to shift the switch sleeve is substantially facilitated.

According to another feature of the present invention, there may be provided a spring, e.g., a helical compression spring, for loading the switch sleeve to seek a position away from an end face of the end portion of the ram. The displacement of the switch sleeve is hereby considerably facilitated in a simple manner, because only one force is required to act upon the switch sleeve to effect a displacement of the switch sleeve in the direction of the end face of the ram, while the return of the switch sleeve in the other direction is realized automatically by the spring. As a consequence, the displacement of the switch sleeve requires only an outside force onto the switch sleeve end face that is distal to the end face of the ram. This can easily be realized through a respective opening in the adjacent sidewall of the switch head. Moreover, as the switch sleeve is moved in the direction of the end face of the ram in opposition to a resistance applied by the spring force, the calibration is fine-tuned and more exact compared to a situation in which an unbiased structural part is displaced. The response temperature can thus be set very accurately.

According to another feature of the present invention, a metal film may be applied onto the end portion of the ram so that the switch sleeve can be directly welded to the ram. There is no need to provide additional components to implement the connection between the switch sleeve and the ram.

According to another feature of the present invention, there may also be applied a coat of solder onto the metal film. In this way, a soldered connection can be realized between the switch sleeve and the metal film on the end portion of the ram through suitably heating the switch sleeve. Supply of solder is not required as the coat of solder has already been deposited on the metal film.

According to another feature of the present invention, there may be provided a receiving sleeve which is placed over the end portion of the ram and connected to the end portion, wherein the switch sleeve is placed over the receiving sleeve. Production and attachment of such a receiving sleeve is overall more economical compared to metallization of the ram end portion and requires only simple and cost-efficient welding or soldering operation for connection of the receiving sleeve to the ram end portion.

According to another feature of the present invention, the receiving sleeve may have an abutment at a location distant to a confronting end face of the switch sleeve, wherein a helical compression spring is arranged between the abutment and the confronting end face of the switch sleeve, for loading the switch sleeve to seek a position away from the end face of the ram end portion. In this way, all components used for implementing the adjustment of the response temperature form a compact unit which can be pre-assembled and then attached to the ram.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
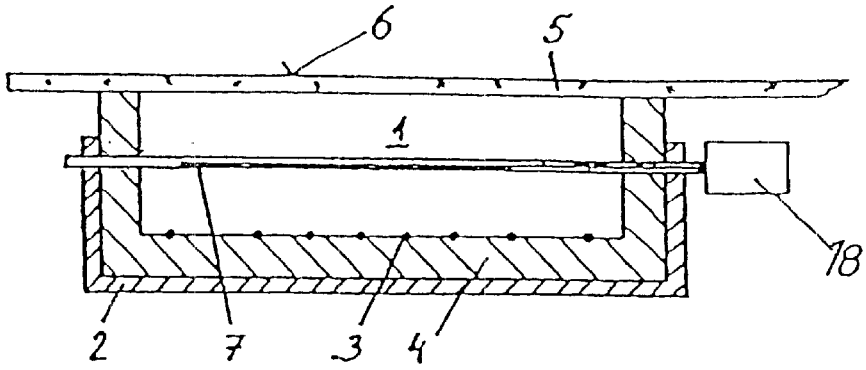
FIG. 1 is a cross-sectional view, taken along the line I—I shown in FIG. 2, through a heating element having incorporated therein a temperature limiter according to the present invention.

For a better understanding of the present invention, the basic construction and a preferred application of a temperature limiter will now be described. Throughout all the Figures, same or corresponding elements are generally indicated by same reference numerals.

Figure 2:
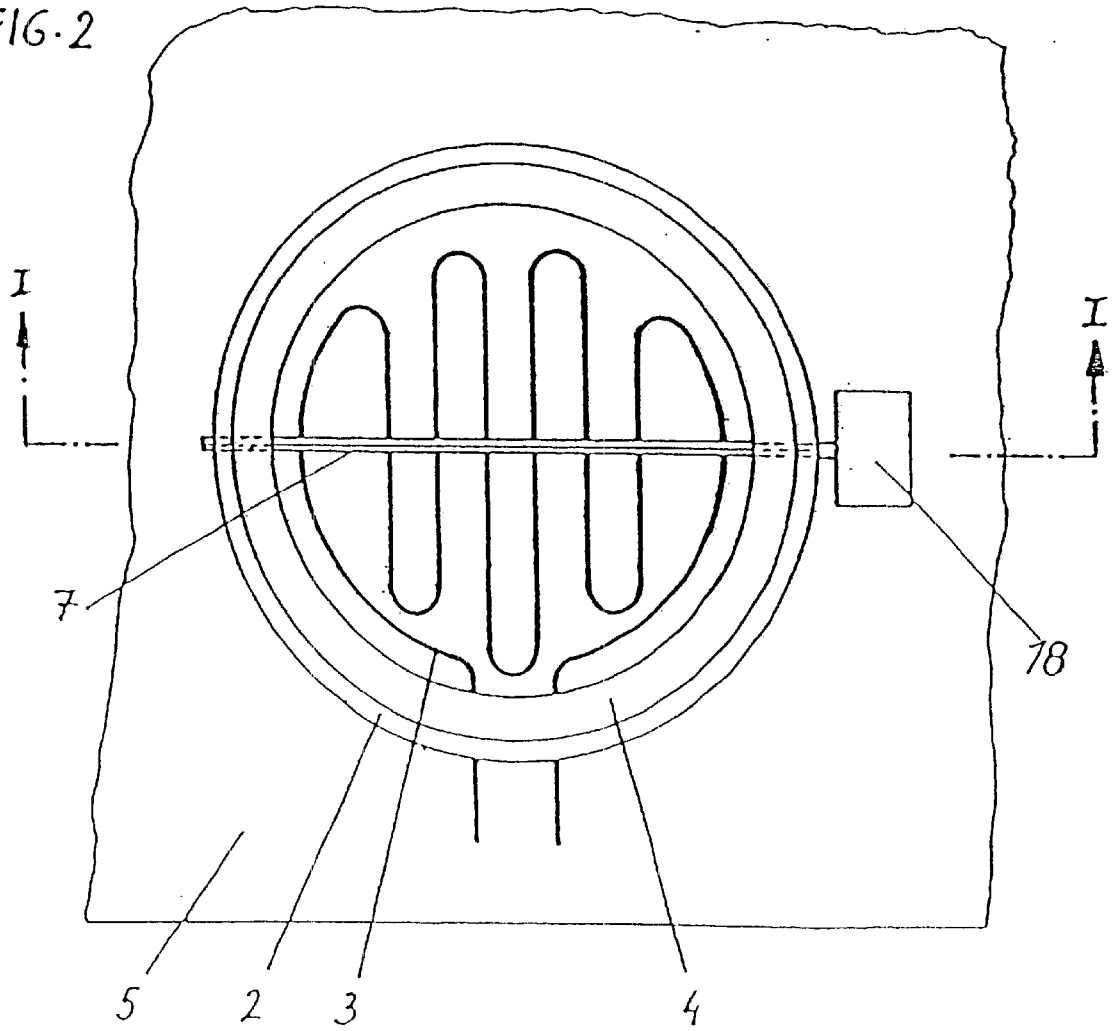
FIG. 2 is a top view of the heating element of FIG. 1.

Turning now to FIGS. 1 and 2, there is shown a temperature limiter according to the present invention for exemplified application in a radiant heating element 1. Of course, the invention is not limited to this application. The radiant heating element 1 includes a cup 2 which received a helically wound heater coil 3 embedded in a potting material. The radiant heating element 1 is located below a plate-shaped cooktop 5 which forms a cooking surface 6 and can be made of metal, glass ceramic and the like. The temperature limiter includes a temperature sensor 7, which is located between the cooking surface 6 and the heater coil 3, and a switch head 18 which is operatively connected to the temperature sensor 7. The temperature sensor 7 can be simply inserted through openings in the radiant heating element 1.

The temperature sensor 7 is exposed to a temperature that exists below the cooking surface 6 in the radiation space between the cooking surface 6 and the heater coil 3, and can hence measure this temperature. The temperature sensor 7 can be constructed in accordance with two basic configuration which are shown in FIGS. 3 and 4 and will now be described.

Figure 3:
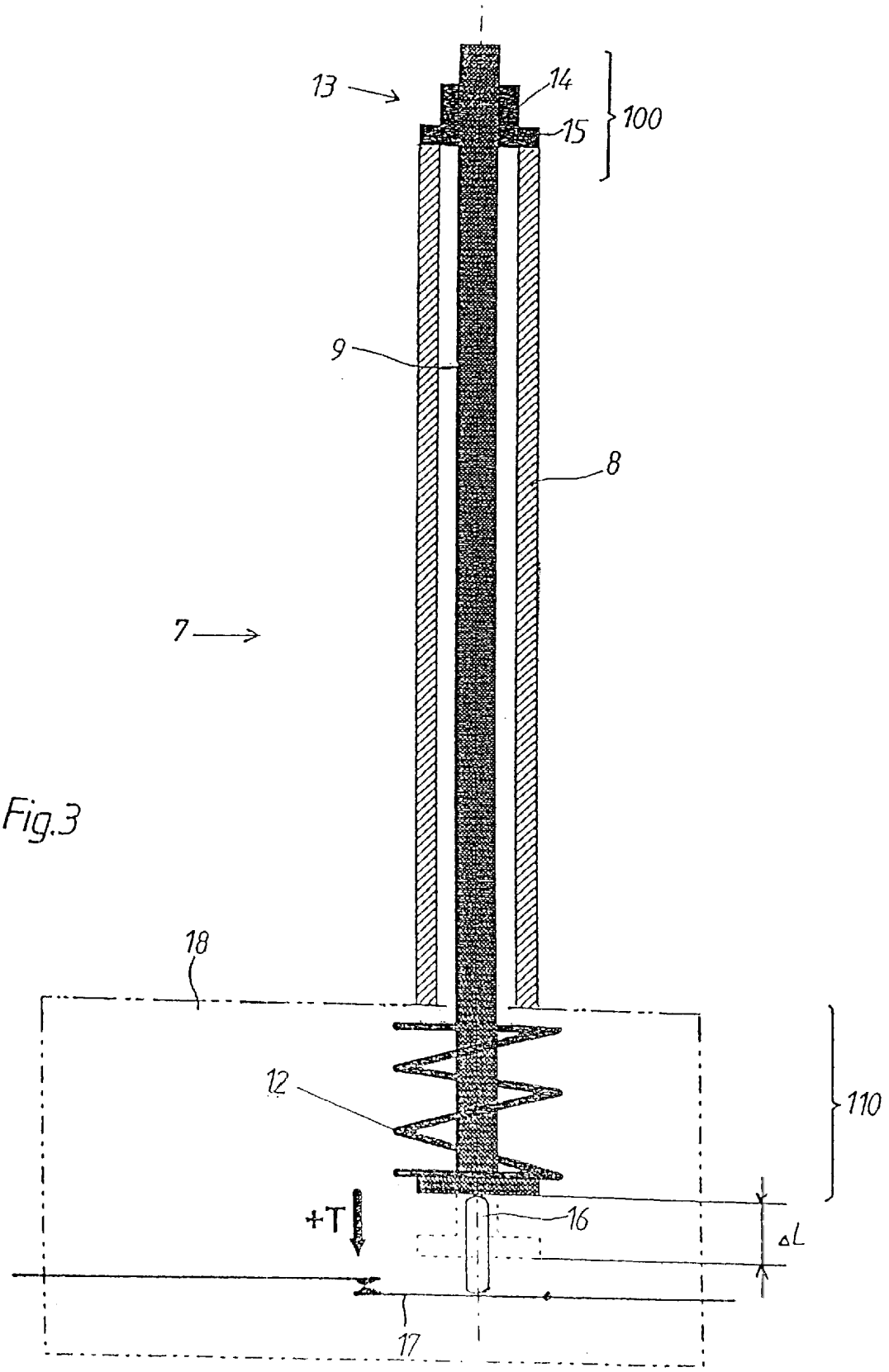
FIG. 3 is a longitudinal section of a first variation of a fundamental configuration of a temperature sensor.
Figure 4:
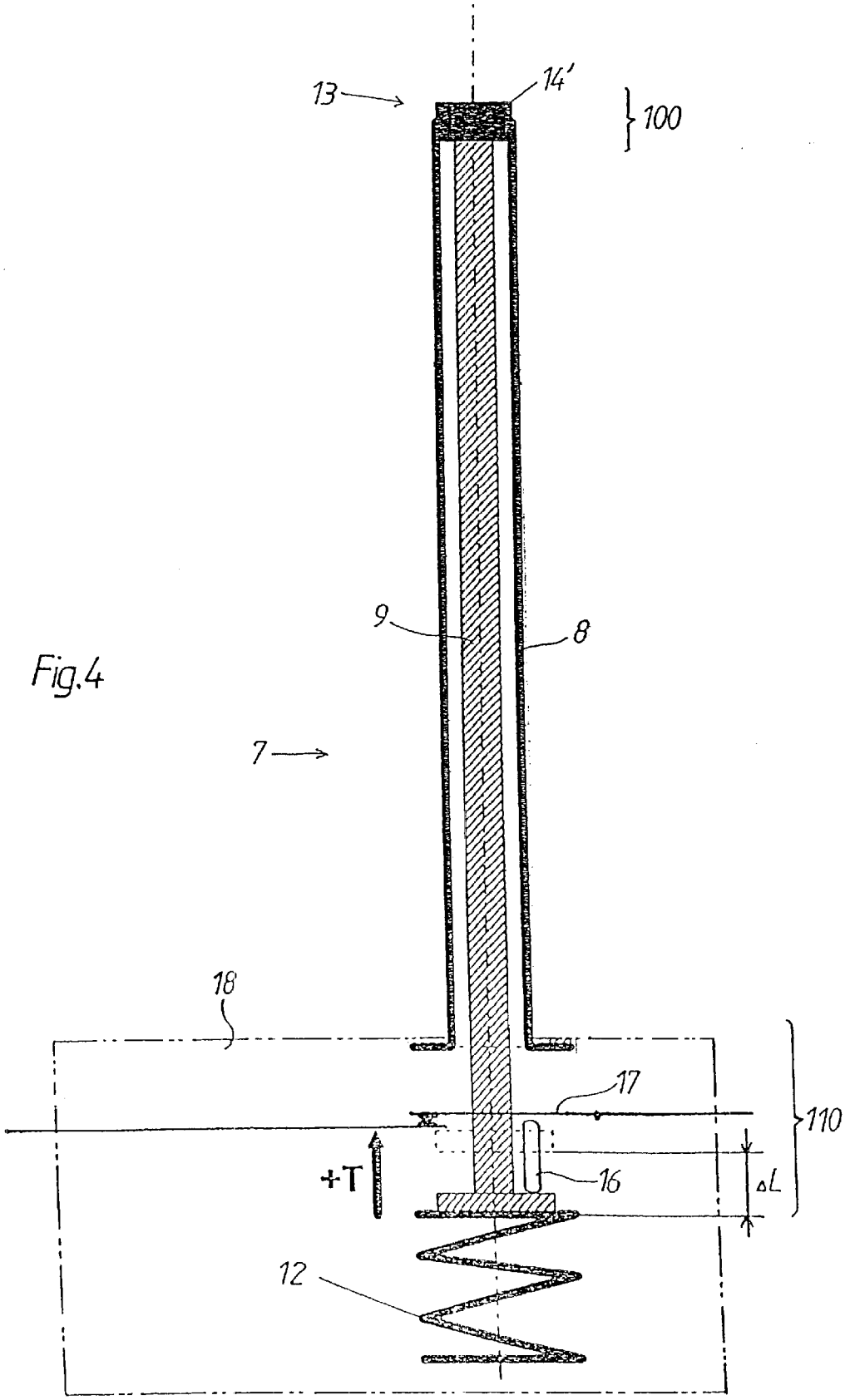
FIG. 4 is a longitudinal section of a second variation of a fundamental configuration of a temperature sensor.

As shown in FIG. 3, the temperature sensor 7 is made of two elongate expansion elements 8, 9 with different thermal expansion coefficients. These expansion elements 8, 9 may be bar-shaped and disposed in side-by-side relationship. Suitably, the one expansion element 8 may be implemented as a tube having, for example, an annular cross section, whereas the other expansion element 9 is implemented as a rod having, e.g., a circular cross section. The rod 9 can hereby be placed inside the tube 8.

For sake of simplicity, the following description will refer to the expansion element 8 as tube 8 while the expansion element 9 will be referred to as rod 9.

The tube 8 and the rod 9 are held in a fixed spatial relationship in an upper end zone 100, while they are able to move relative to one another in a lower end zone 110, i.e., in the region of the switch head 18. In the following description, the term "upper" will denote a direction toward (or proximity with respect to) those portions of the temperature sensor 7 which appear on the upper portion of FIG. 3 or 4 and are distal to the switch head 18, while the term "lower" will denote the opposite location or direction and thus is proximal to the switch head 18.

In the embodiment depicted in FIG. 3, the expansion coefficient of the rod 9 is greater than the expansion coefficient of the tube 8. This may be realized, for example, by making the rod 9 of a metal and the tube 8 of a ceramic material, such as Cordierit. The rod 9 is fixedly secured to the tube 8 in the end zone 100 via a stop member 13 which is affixed on the rod 9. The upper end of the rod 9 can hereby be supported with the stop member 13 on the proximal end of the tube 8. The stop member 13 may be formed, for example, by a component, which is non-releasably connected with the rod 9, for example by welding or gluing. An alternative configuration is shown in FIG. 3 and involves the provision of a stop member 13 in the form of a nut 14, which is screwed onto the threaded upper end of the rod 9, and a shim washer 15, which is disposed between the nut 13 and the upper end of the tube 8.

A spring 12, for example a helical compression spring, is arranged in the lower end zone 110, to bias the lower end of the rod 9 in a direction away from the lower end of the tube 8. As a consequence of the bias, the stop member 13 is urged against the upper end of the tube 8, thereby keeping the rod 9 and the tube 8 in the upper end zone 100 in a fixed relationship relative to one another.

When heat is applied to the temperature sensor 7, the rod 9 expands more than the tube 8. As a result, the lower end of the rod 9 can move away from the lower end of the tube 8, as indicated by the arrow +T in FIG. 3. The resultant relative displacement between the lower end of the rod 9 and the lower end of the tube 8 can provide a measurement value which is directly proportional to the temperature of the sensor 7 and therefore also for the temperature of the environment of the sensor 7. The length change of the rod 9 is indicated in the FIG. 3 by the reference symbol ΔL. The change in length of the tube 8 can essentially be neglected, since the tube 8 is made of ceramic. The measurements can be evaluated in different ways. Most frequently used is a method depicted schematically in FIG. 3, wherein the lower end of the rod 9 activates a switching contact 17, shown only schematically, via a ram 16. The switching contact 17 can be connected in series with a resistive heating element that heats the surroundings of the temperature sensor 7, in particular the cooking area depicted in FIGS. 1 and 2. This allows the temperature produced in this area to be limited and/or controlled.

The switching contact 17 and the ram 16 are hereby supported in the switch head 18, on which the lower end of the tube 8 is also secured. The lower end of the tube 8 and the switching contact 17 are hereby maintained in a fixed relationship with respect to one another. The switching contact 17 can be activated by the lower end of the rod 9 that is movably supported in the switch head 18.

The embodiment of FIG. 4 operates according to a same basic principle. Parts corresponding with those in FIG. 3 are denoted by identical reference numerals and not explained again. In the embodiment of FIG. 4, the tube 8 has a greater thermal expansion coefficient than the rod 9. In the upper end zone 100, the tube 8 is closed, for example, with a plug 14' made of metal and welded to the tube 8, with the end face of the rod 9 contacting the plug 14'. The lower end of the tube 8 is again secured to the switch head 18, whereas the lower end of the rod 9 is movably supported in the switch head 18 and urged into the tube 8 by a spring 12.

When the temperature increases, the tube 8 expands, whereby the lower end of the rod 9 is moved towards the tube 8, as indicated by arrow +T. This relative movement can be processed in different ways, and used, for example, to activate a switching contact 17.

Figure 5:
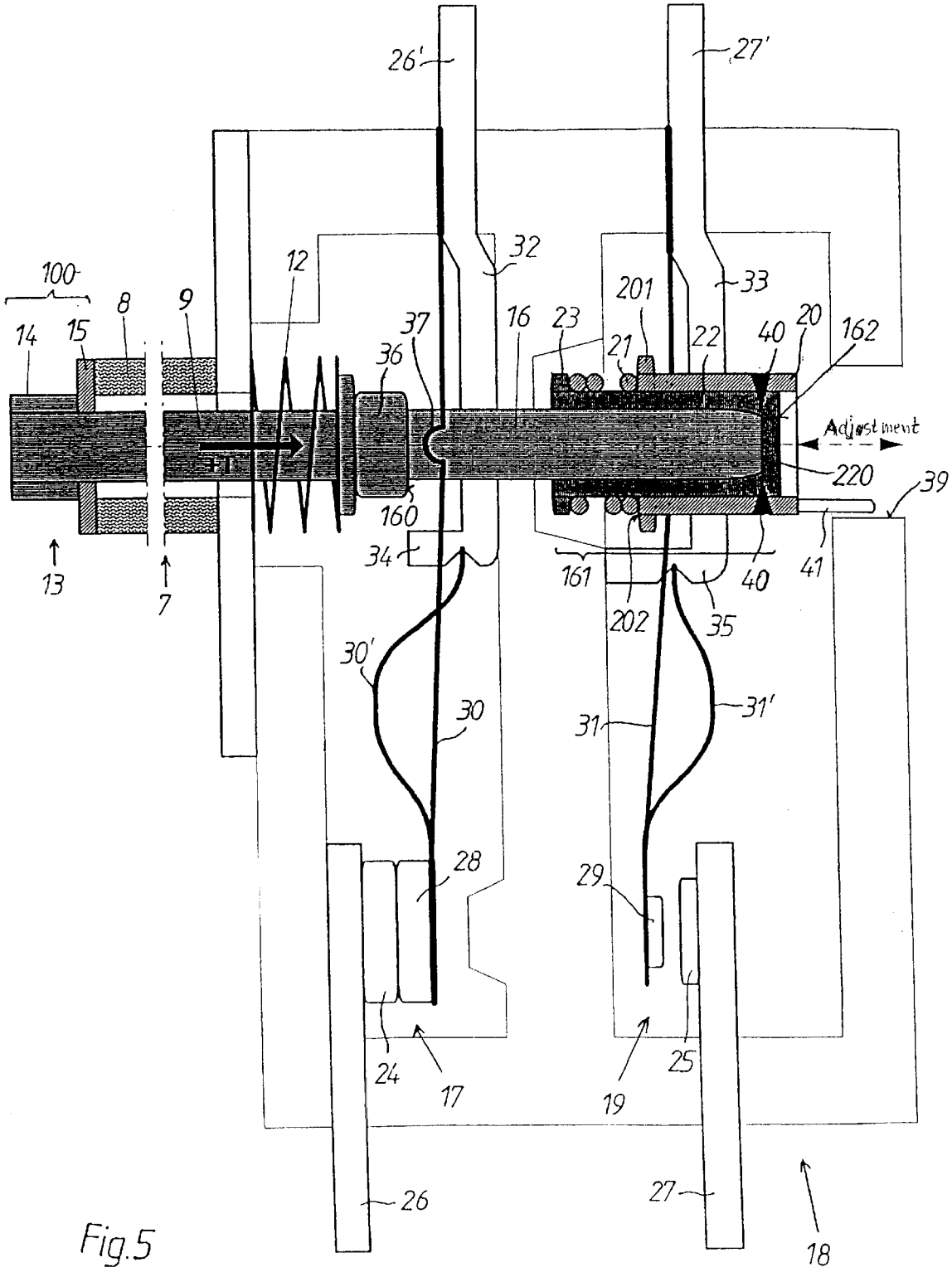
FIG. 5 is a schematic plan view of a first embodiment of a temperature limiter according to the present invention, incorporating a temperature sensor constructed on the basis of the first fundamental configuration.

Turning now to FIG. 5, there is shown a schematic plan view of a first embodiment of a temperature limiter according to the present invention, incorporating the temperature sensor 7 constructed on the basis of the first fundamental configuration, shown in FIG. 3. Parts corresponding with those in FIG. 3 are denoted by identical reference numerals and not explained again. In this embodiment, the switch head 18 of the temperature limiter has a further switching contact 19 in addition to the switching contact 17, whereby the ram 16 actuates both switching contacts 17, 19. The switching contact 17, which is located in closer proximity to the temperature sensor 7 than the switching contact 19 and constitutes the primary heat contact, is normally provided to cut the energy supply to the heating element 1 of the cooktop 5, when the temperature of the cooking surface 6 reaches an inadmissible level. The switching contact 17 is hereby connected in series to the heating element 1, when the heating element is configured as helical heater coil 3.

The switching contact 19 is normally used to provide a so-called heat indication, i.e. to signal that the cooktop 5 is too hot for a user to touch the cooking surface 6 without risk of injury. This is implemented by providing a signaling unit which is controlled by the switching contact 19 and displays in any fashion known to the artisan, e.g. optically or acoustically, that the temperature is too high. Examples of optical signaling units include lamps or bulbs situated below the cooking surface 6 in spaced-apart relationship to visually display which zones of the cooking surface 6 can be touched and which zones cannot be touched without risking injury.

As a consequence of their functionality, it is evident that the switching contact 19 should be operated at a significantly lower temperature than the switching contact 17. The following description deals primarily with a construction of the switching contact 19 to adjust its operating or response temperature.

Both switching contacts 17, 19 have each a fixed contact piece 24, 25, which is connected to a terminal lug 26, 27, projecting out of the casing of the switch head 18. The fixed contact pieces 24, 25 interact with respective movable contact pieces 28, 29 held on contact springs 30, 31 which are supported on contact supports 32, 33 and connected electrically with further terminal lugs 26', 27'. Each of the contact springs 30, 31 includes a stamped tab 30', 31', which is supported by a support 34, 35 connected with the contact support 32, 33 and the contact spring 30, 31. By means of the tabs 30', 31', the contact springs 30, 31 are biased into their position, shown in FIG. 5, in which the switching contact 17 is closed and the switching contact 19 is open. The supports 34, 35 as well as the contact springs 30, 31 have apertures to allow passage of the ram 16.

The ram 16 includes a head 36, which has one end face for abutment against the rod 9 of the temperature sensor 7 and another opposite end face for forming a shoulder 160 for interaction of the ram 16 with the switching contact 17. As the ram 16 shifts during a temperature change, the shoulder 160 of the head portion 36 moves first against a transverse rib 37 of the contact spring 30 and is able to then deflect the transverse rib 37 and thus the contact spring 30.

Figure 7:
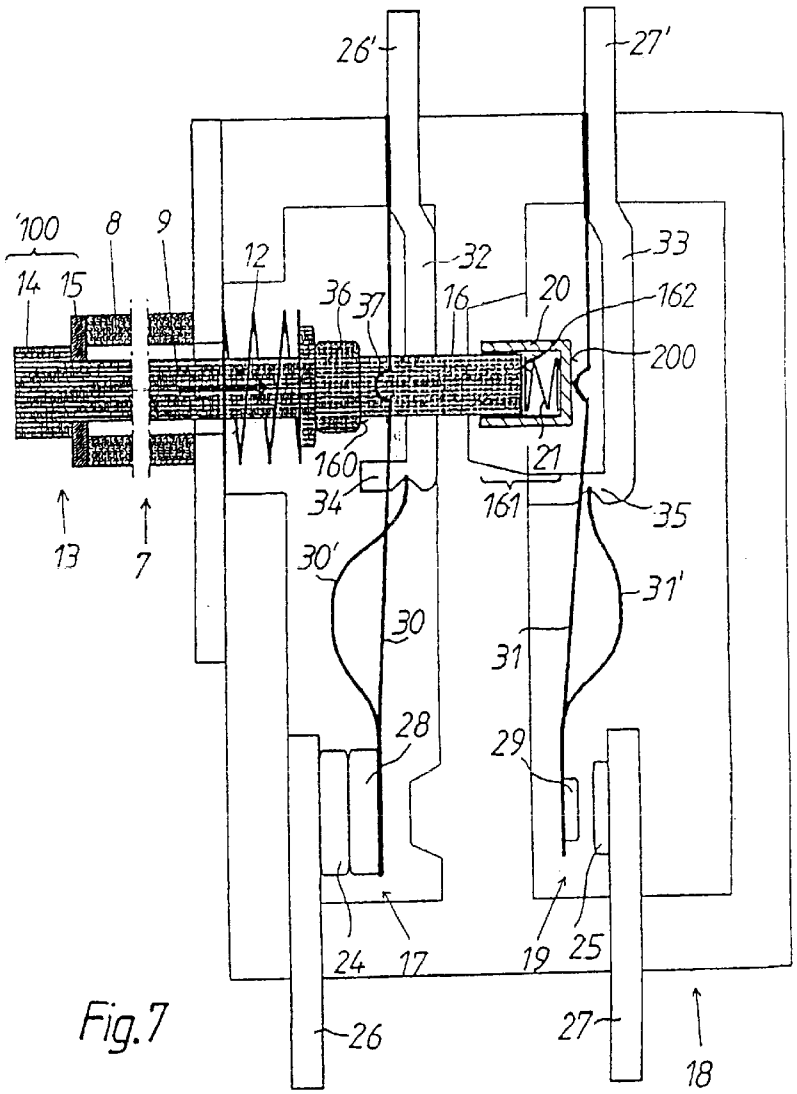
FIG. 7 is a schematic illustration of a third embodiment of a temperature limiter according to the present invention, incorporating a temperature sensor constructed on the basis of the first fundamental configuration.
Figure 6:
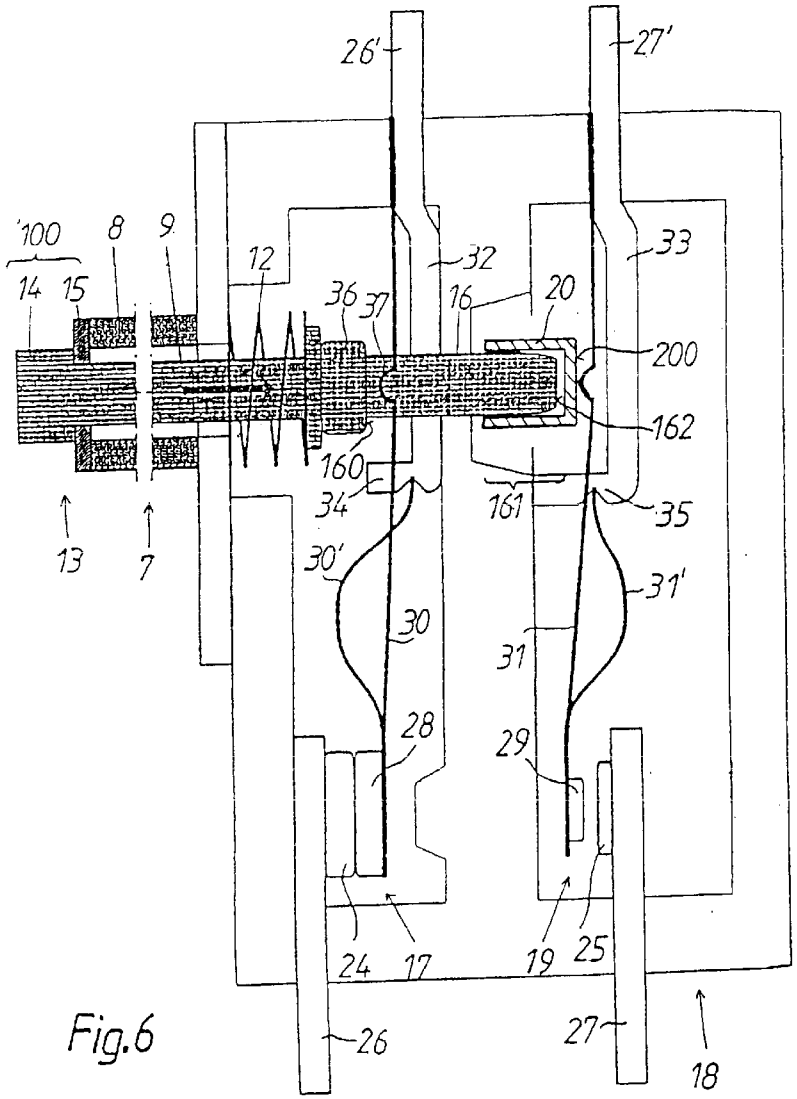
FIG. 6 is a schematic illustration of a second embodiment of a temperature limiter according to the present invention, incorporating a temperature sensor constructed on the basis of the first fundamental configuration.

The switching contact 19 could, conceivably, be operated by the ram 16 in similar manner as the switching contact 17, by pressing the end portion 161 of the ram 16 against the contact spring 31. However, this solution suffers shortcomings as previously noted. Accordingly, as shown in FIGS. 5 to 8, the end portion 161 is configured to act on the contact spring 31 via a switch sleeve 20 and thus to cooperate indirectly with the switching contact 19. The switch sleeve 20 is placed over the end portion 161 and movable relative thereto. One possibility to implement the relative movement can simply be realized by sizing the inner diameter of the switch sleeve 20 slightly greater than the outer diameter of the end portion 161 of the ram 16, as best seen in FIGS. 6 and 7.

Actuation of the contact spring 31 by means of the switch sleeve 20 can be realized by forming the switch sleeve 20 with an actuating mechanism for abutment against the confronting end of the contact spring 31. In the embodiment of FIG. 5, the actuating mechanism is formed by a flange 201, e.g., of annular configuration, which is attached to the outer surface of the switch sleeve 20. As an alternative, as shown in FIG. 6, the actuating mechanism is realized by providing the switch sleeve 20 with a bottom 200 which is intended to abut against the contact spring 31.

Through displacement of the switch sleeve 20 relative to the ram 16, it is possible to modify the distance between the actuating mechanism 201, 200 and the contact sleeve 31 and thereby select the temperature that results in a response of the switching contact 19. The response temperature of the switching contact 19 is thus set by positioning the switch sleeve 20 at a corresponding distance from the contact spring 31 and by securely fixing the switch sleeve 20 in this position to the end portion 161 by means of fusion welding or soldering. The end portion 161 of the ram 16 is hereby configured to allow application of the welding or soldering process. This can be implemented in various ways, for example, by applying a metal film onto the end portion 161, e.g., by means of a sputtering process. Of course, any process that is appropriate to apply a metal film on the end portion 161 should be considered covered by this disclosure.

Melt generated during welding as a result of partially heating the switch sleeve 20 bonds with the metal film and thus with the ram 16. Instead of metallizing the surface of the ram 16, which is normally made of ceramics, it is also possible to roughen the ram surface to an extent that allows penetration of the melt into the surface irregularities to thereby effect a sufficient fixation with the ram surface. The melt may be produced through various welding processes, e.g., resistance friction welding. Currently preferred is the use of laser welding to connect the switch sleeve 20 to the ram 16.

When connecting the switch sleeve 20 to the ram 16 by soldering, a metal film is applied onto the end portion 161 and a coat of solder is then deposited on the metal film. There are many ways to heat the switch sleeve 20 and the metal film to a temperature above the temperature of the solder. Currently preferred is the use of a laser beam.

Figure 8:
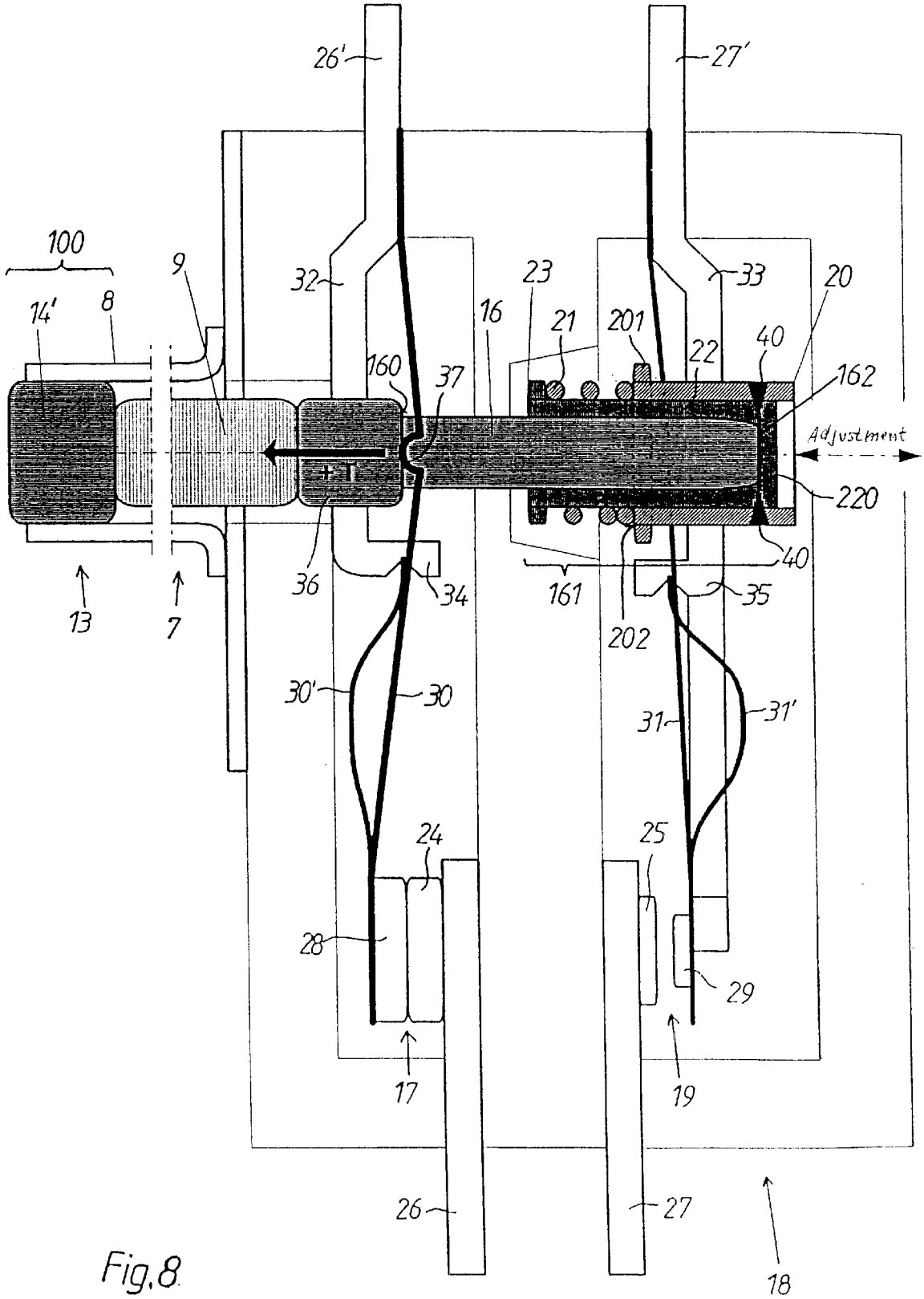
FIG. 8 is a schematic illustration of a fourth embodiment of a temperature limiter according to the present invention, incorporating a temperature sensor constructed on the basis of the second fundamental configuration.

While in FIGS. 6 and 7, the switch sleeve 20 is directly placed over the end portion 161 of the ram 16, and the end portion 161 is made suitable for welding or soldering by applying a metal film, FIGS. 5 and 8 show configurations in which a metallic receiving sleeve 22 is placed between the end portion 161 of the ram 16 and the switch sleeve 20 to make the end portion 161 suitable for welding or soldering.

In order to precisely position the switch sleeve 20 on the end portion 161, the switch sleeve 20 is provided with a gripping aid, e.g., a pin 41 by which the switch sleeve 20 can be moved in and out through application of respective pull or push forces relative to the end portion 161. Suitably, the switch sleeve 20 is formed with an internal thread for threaded engagement of the pin 41. Once the switch sleeve 20 has been properly positioned, the pin 41 is removed. The gripping aid may also be implemented by forming the outer surface area of the switch sleeve 20 with several indentations or by roughening the outer surface area of the switch sleeve 20. Friction forces generated between the switch sleeve 20 and a gripping tool utilized to effect the displacement of the switch sleeve 20 are thereby increased so that the gripping tool is prevented from slipping off the switch sleeve 20 during displacement.

In the embodiments shown in FIGS. 5 and 7, the switch sleeve 20 is loaded by a spring 21 to seek a position away from the end face 162 of the ram 16. Construction and disposition of the spring 21 can be chosen in any suitable manner. Currently preferred is the use of a helical compression spring, which is shown in FIG. 7 and disposed between the end face 162 of the ram 16 and the bottom 200 of the switch sleeve 20. In FIG. 5, the helical compression spring 21 is stretched between the flange 201 of the switch sleeve 20 and an abutment 23 on the receiving sleeve 22.

In order to provide access to the switch sleeve 20 to implement the calibration and an exact positioning of the switch sleeve 20 for setting the response temperature of the switching contact 19, the switch head 18 is formed with an opening 39 in the sidewall adjacent to the proximal end 200 of the switch sleeve 20. Displacement of the switch sleeve 20 in the direction of the end face 162 of the ram 16 requires only application of pressure upon the switch sleeve 20, whereas a displacement in the opposite direction can merely be attained by reducing this pressure, as the spring 21 urges the switch sleeve 20 back again.

The embodiment of FIG. 5 of the temperature limiter includes the provision of the receiving sleeve 22 which is placed over the end portion 161 and connected thereto. This connection may be firm enough, for example, through a press fit between the end portion 161 and the receiving sleeve 22, to prevent any relative movement between the ram 16 and the receiving sleeve 22. Of course, it is also conceivable to cement, weld or solder the receiving sleeve 22 to the ram 16. In order to allow application of a welding or soldering process, the end portion 161 may be coated by a metal film, as described above. It is, however, sufficient to so configure the connection that the ram 16 moves the receiving sleeve 22 as the temperature increases, whereby, as shown in FIG. 5, the end face 162 of the ram 16 bears against the bottom wall 220 of the receiving sleeve 22. Provided at the receiving sleeve 22 at a distance to the end 202 of the switch sleeve 20 is the abutment 23 for support of one end of the spring 21, which is suitably a helical compression spring, whose other end is supported by the end 202 of the switch sleeve 20. Suitably, the abutment 23 is formed in one piece with the receiving sleeve 22.

Calibration of the response temperature of the switching contact 19 is as follows: The receiving sleeve 22 is pressed against the ram 16 which in turn is forced thereby against the rod 9. The switch sleeve 20 is now pushed far enough in the direction of the switching contact 17 in opposition to the force of the spring 21 so that the switching contact 19 opens. As of this switching point, the switch sleeve 20 is shifted further in the direction of the switching contact 17 by a distance which corresponds to the difference between the desired response temperature and the actual room temperature. The length of this distance can be calculated because the thermal expansion coefficients of the tube 8 and rod 9 as well as their lengths are known. As soon as the desired distance is established, the switch sleeve 20 is firmly connected to the receiving sleeve 22, e.g., by laser welding, using two to four welding points 40. Thus, the switch sleeve 20 is also connected with the end portion 161 of the ram 16, although not directly but indirectly via the receiving sleeve 22. Suitably, the receiving sleeve 22 and the switch sleeve 20 are made of materials of similar melting points to allow welding of these two components, for example, metals.

Of course, the arrangement of spring 21 may be omitted in the embodiment of FIG. 5, analog to the embodiment of FIG. 6. However, this is accompanied by the drawback that the switch sleeve 20 has to be shifted also in a direction away from the end face 162 through application of an outside force on the switch sleeve 20. Application of such an outside (pull) force may be facilitated through provision of gripping aids, as described above.

Turning now to FIG. 8, there is shown a schematic illustration of another embodiment of a temperature limiter according to the present invention, incorporating a temperature sensor 7 constructed on the basis of the basic configuration shown in FIG. 4. Parts corresponding with those in FIG. 4 are denoted by identical reference numerals and not explained again. In this embodiment, the tube 8 is made of material having a higher thermal expansion coefficient than the rod 9 received inside the tube 8. Unlike in the embodiments of FIGS. 5 to 7 in which the ram 16 moves during temperature increase in a direction away from the temperature sensor 7, the ram 16 moves now during temperature increase in the direction towards the temperature sensor 7. In order to still implement an opening of the switching contact 17 and closing of the switching contact 19 during increase in temperature, the positions of the fixed contact pieces 24, 25 and the movable contact pieces 28, 29 have been exchanged in each of the switching contacts 17, 19.

In the switching contact 19, the movable contact piece 29 is loaded by the contact spring 31 to seek a position in which the contact piece 29 bears against the contact piece 25. The contact spring 31 is able to move the movable contact piece 29 into this closed position, when the switch sleeve 20, which is connected to the end portion 161 and acting on the contact spring 31, releases the contact spring 31.

Setting of the temperature to release the contact spring 31, i.e. the response temperature of the switching contact 19, is as follows: The receiving sleeve 22 is pressed against the ram 16 which in turn is hereby forced against the rod 9. The switch sleeve 20 is then shifted far enough in the direction of the switching contact 17 in opposition of the force applied by the spring 21 until the switching contact 19 closes. At this point, the force applied onto the switch sleeve 20 is reduced until the spring 21 urges the switch sleeve 20 back, i.e. away from the switching contact 17. Hereby, the switch sleeve 20 is moved back sufficient that the switching contact 19 opens. At this moment, the switch sleeve 20 is further shifted back by such a distance which corresponds to a difference between the desired response temperature and the actual room temperature. The length of this distance can be calculated because the thermal expansion coefficients of the tube 8 and rod 9 as well as their lengths are known.

As soon as the desired distance is established, the switch sleeve 20 is firmly connected to the receiving sleeve 22, e.g., by laser welding, using two to four welding points 40. Also in the embodiment of the temperature limiter according to FIG. 8, based on the construction principle of FIG. 4, the use of a receiving sleeve 22 may be omitted, analog to FIGS. 6 and 7, when the surface of the ram 16 is made suitable for welding or soldering in the area of the end portion 161, for example through metallizing or roughening of the end portion 161.

Also the provision of spring 21 is not mandatory. Without spring 21, the switch sleeve 20 has to be moved in both directions by outside forces towards and away from the end face 162 of the ram 16. Application of pull and push forces can be facilitated by providing the switch sleeve 20 with gripping aids.

In the embodiment of FIG. 8, the contact spring 30 of the switching contact 17 is also used to urge the rod 9 against the plug 14' (just like the spring 12 in FIG. 4). Of course, a separate spring may also be arranged to assume this function.

While the invention has been illustrated and described as embodied in a temperature limiter, and calibration method for operating a switching contact of a temperature limiter, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated. For example, the invention should not be limited to the use of a switch head with two switching contacts, because other embodiments which generally follow the concepts outlined here are considered to be covered by this disclosure. For example, the use of only one switching contact 19 which is actuated by the end portion 161 of the ram 16 is certainly also conceivable.

It is clear from the previous description that the disclosure refers to a temperature limiter which can be offered by a manufacturer in an already assembled state, i.e. the switch sleeve 20 is already mounted to the ram 16, as well as to a temperature limiter in which the switch sleeve 20 and the ram 16 have not yet been connected together. In the first case, the manufacturer carries out the calibration of the device for the correct response temperature of the switching contact 19, whereas in the other case, a customer, e.g. the maker of the heater, may carry out the proper calibration.

What is claimed as new and desired to be protected by Letters Patent is set forth in the appended claims and their equivalents:

1. A temperature limiter, comprising:

a switch head including at least one switching contact;

a temperature sensor including elongate expansion elements which have different thermal expansion coefficients and are defined by a switch head distal first end zone where the expansion elements are fixed immobile relative to one another, and a switch head proximal second end zone where one of the expansion elements is movable relative to the other expansion element;

a ram slidably supported in the switch head and abutting against the movable expansion element, with the ram having an end portion which is situated in an area of the switching contact and constructed to allow application of a process selected from the group consisting of welding and soldering; and a switch sleeve placed over the end portion of the ram and adapted for actuation of the switching contact, wherein the switch sleeve is movable relative to the ram during a calibration phase, until reaching a position which is determinative for calibrating a desired response temperature of the switching contact and in which position the switch sleeve is securely fixed to the end portion of the ram through a process selected from the group consisting of fusion welding and soldering.

2. The temperature limiter of claim 1, wherein the switch sleeve is connected to the end portion by a process selected from the group consisting of laser welding and laser soldering.

3. The temperature limiter of claim 1, wherein the switch sleeve has a gripping aid.

4. The temperature limiter of claim 3, wherein the gripping aid is an element selected form the group consisting of pin secured to the switch sleeve, indentations in an outer surface area of the switch sleeve, and roughening of the outer surface area of the switch sleeve.

5. The temperature limiter of claim 1, and further comprising a spring for loading the switch sleeve to seek a position away from an end face of the end portion of the ram.

6. The temperature limiter of claim 5, wherein the spring is a helical compression spring.

7. The temperature limiter of claim 1, and further comprising a metal film for application onto the end portion.

8. The temperature limiter of claim 7, and further comprising a coat of solder for application onto the metal film.

9. The temperature limiter of claim 1, and further comprising a receiving sleeve placed over the end portion of the ram and connected to the end portion, wherein the switch sleeve is placed over the receiving sleeve.

10. The temperature limiter of claim 9, wherein the receiving sleeve has an abutment at a location distant to a confronting end face of the switch sleeve, and further comprising a helical compression spring, extending between the abutment and the confronting end face of the switch sleeve, for loading the switch sleeve to seek a position away from an end face of the end portion of the ram.

11. The temperature limiter of claim 10, wherein the abutment has a ring-shaped configuration.

12. A method of calibrating the operation of a switching contact of a temperature limiter, comprising the steps of:

arranging a switch sleeve over an end portion of a temperature sensor forming another part of the temperature limiter;

moving the sleeve relative to the end portion to a first position which is commensurate with an operation of the switching contact in response to a desired response temperature;

advancing the switch sleeve from the first position relative to the end portion by a distance which is commensurate with a difference between the desired response temperature and an actual room temperature to define a second position; and securely fixing the switch sleeve in the second position to the end portion of the temperature sensor through a process selected from the group consisting of fusion welding and soldering.

13. The method of claim 12, wherein the switch sleeve is connected to the end portion by a process selected from the group consisting of laser welding and laser soldering.

14. The method of claim 12, and further comprising the step of depositing a metal film onto the end portion, to make the end portion suitable for application of the process.

15. The method of claim 14, and further comprising the step of depositing a coat of solder onto the metal film.

16. The method of claim 12, and further comprising the steps of placing a receiving sleeve over the end portion of the temperature sensor, and securely fixing the receiving sleeve to the end portion, before arranging the switch sleeve over the end portion of the temperature sensor by placing the switch sleeve over the receiving sleeve.

* * * * *

UNITED STATES PATENT AND TRADEMARK OFFICE

CERTIFICATE OF CORRECTION

PATENT NO. : 6,646,538 B2
DATED : November 11, 2003
INVENTOR(S) : Hans-Peter Morbitzer It is certified that error appears in the above-identified patent and that said Letters Patent is hereby corrected as shown below:

Title page,
Item [30], Foreign Application Priority Data, should read:
-- April 17, 2001 (AT) A 621/2001 --

Signed and Sealed this

First day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,646,538 B2
DATED : November 11, 2003
INVENTOR(S) : Hans-Peter Morbitzer It is certified that error appears in the above-identified patent and that said Letters Patent is hereby corrected as shown below:

Title page,
Item [73], Assignee, "Gesellschft" should read -- Gesellschaft --.

Signed and Sealed this

Twentieth Day of September, 2005

JON W. DUDAS
*Director of the United States Patent and Trademark Office*